US009827459B2

(12) United States Patent
Hsu

(10) Patent No.: US 9,827,459 B2
(45) Date of Patent: Nov. 28, 2017

(54) COLLAPSIBLE EXERCISE MACHINE

(71) Applicant: GREAT FITNESS INDUSTRIAL CO., LTD., Tainan (TW)

(72) Inventor: Chih-Yung Hsu, Tainan (TW)

(73) Assignee: Great Fitness Industrial Co., Ltd., Tainan (TW)

( * ) Notice: Subject to any disclaimer, the term of this patent is extended or adjusted under 35 U.S.C. 154(b) by 0 days.

(21) Appl. No.: 15/092,936

(22) Filed: Apr. 7, 2016

(65) Prior Publication Data

US 2017/0291056 A1 Oct. 12, 2017

(51) Int. Cl.

| | |
|---|---|
| ***A63B 21/02*** | (2006.01) |
| ***A63B 26/00*** | (2006.01) |
| ***A63B 21/04*** | (2006.01) |
| ***A63B 21/00*** | (2006.01) |
| ***A63B 24/00*** | (2006.01) |
| ***A63B 23/035*** | (2006.01) |

(52) U.S. Cl.

CPC ..... *A63B 21/0442* (2013.01); *A63B 21/4035* (2015.10); *A63B 23/03516* (2013.01); *A63B 24/00* (2013.01); *A63B 2210/50* (2013.01); *A63B 2210/54* (2013.01)

(58) Field of Classification Search

CPC ..... A63B 21/0442; A63B 21/4035; A63B 23/03516; A63B 24/00; A63B 2210/50; A63B 2210/54

USPC ..... 482/51, 72, 73, 121–126, 140, 142–147, 482/908

See application file for complete search history.

(56) References Cited

U.S. PATENT DOCUMENTS 4,546,967 A * 10/1985 Kecala ..... A63B 21/4031 482/102
4,747,594 A * 5/1988 Houde ..... A63B 21/023 482/129
6,726,607 B1 * 4/2004 Ihli ..... A63B 21/015 482/115
6,981,932 B1 * 1/2006 Huang ..... A63B 21/00072 482/121
7,125,371 B2 * 10/2006 Henderson ..... A63B 21/068 482/142
8,007,423 B2 * 8/2011 Solow ..... A63B 21/023 482/142

(Continued)

FOREIGN PATENT DOCUMENTS

TW M433875 U 7/2012

*Primary Examiner* — Stephen R Crow
*Assistant Examiner* — Garrett Atkinson
(74) *Attorney, Agent, or Firm* — Rosenberg, Klein & Lee

(57) ABSTRACT

A collapsible exercise machine includes a stationary base, a moving member, and a supporting frame. The stationary base includes a pivotally connecting portion and a first supporting portion. The moving member is pivotally connected to the pivotally connecting portion of the stationary base, can be pivoted to an extended position and a collapsed position with respect to the stationary base, and includes a second supporting portion. The supporting frame includes a third supporting portion, is fixedly connected to the stationary base, and lies under the pivotally connecting portion. When in the extended position, the stationary base and the moving member are supported by the third supporting portion as well as the first supporting portion and the second supporting portion.

7 Claims, 8 Drawing Sheets

(56) References Cited

U.S. PATENT DOCUMENTS

2011/0224057 A1* 9/2011 Wu ..... A63B 21/4043
482/130

* cited by examiner

COLLAPSIBLE EXERCISE MACHINE

BACKGROUND OF THE INVENTION

1. Technical Field

The present invention relates to an exercise machine and more particularly to a collapsible exercise machine.

2. Description of Related Art

Taiwan Utility Model Patent No. M433875, entitled "COLLAPSIBLE STRUCTURE OF EXERCISE MACHINE", discloses a collapsible structure including a stationary member, a moving member pivotally connected to the stationary member, and a pin mounted to the stationary member and switchable between a locked state and a released state. The moving member can pivot between an extended state and a collapsed state with respect to the stationary member and includes an extended state-locking pin hole corresponding to the extended state and a collapsed state-locking pin hole corresponding to the collapsed state. The pin is engaged in the extended state-locking pin hole when in the extended state and is engaged in the collapsed state-locking pin hole when in the collapsed state. The moving member can be locked in the extended state and the collapsed state thanks to the pin, the extended state-locking pin hole, and the collapsed state-locking pin hole of the collapsible structure.

While the moving member in the aforesaid patent can pivot with respect to the stationary member and be locked in position with the pin, the pivotally connecting portion is left unsupported. During the extending/collapsing process, therefore, the stationary member and the moving member may fall apart because the pivotally connecting portion is insecure.

BRIEF SUMMARY OF THE INVENTION

To overcome the foregoing drawback, the present invention provides a collapsible exercise machine which includes a stationary base, a moving member, and a supporting frame.

The stationary base includes a pivotally connecting portion and a first supporting portion. The moving member is pivotally connected to the pivotally connecting portion of the stationary base. The moving member is configured to pivot to an extended position and a collapsed position with respect to the stationary base. The moving member includes a second supporting portion. The supporting frame includes a third supporting portion and is fixedly connected to the stationary base. The supporting frame lies under the pivotally connecting portion. When in the extended position, the stationary base and the moving member are supported by the third supporting portion as well as the first supporting portion and the second supporting portion.

Preferably, the collapsible exercise machine further includes a pin movably connected to the supporting frame and displaceable between a first position and a second position, and the supporting frame further has at least one positioning hole. When the pin is in the first position, the moving member can be selectively pivoted to the collapsed position or the extended position with respect to the stationary base. When in the second position, the pin is engaged in the at least one positioning hole to lock the moving member in the collapsed position or the extended position.

The pin includes a receiving sleeve, an elastic restoring member, and an inserting member. The receiving sleeve is fixedly connected to the moving member. Both the elastic restoring member and the inserting member are received in the receiving sleeve. The two ends of the elastic restoring member are pressed against the inserting member and the receiving sleeve respectively such that the pin is moved to correspond to the second position.

Preferably, the at least one positioning hole includes an extended position-locking pin hole and a collapsed position-locking pin hole. The pin is selectively engaged in the extended position-locking pin hole or the collapsed position-locking pin hole to lock the moving member in the extended position or the collapsed position respectively.

The supporting frame includes a connecting portion and a bearing portion. The connecting portion is fixedly connected to the stationary base. The moving member rests on the bearing portion after being pivoted to the extended position with respect to the stationary base.

The pivotally connecting portion includes a first fixing plate, a second fixing plate, and a connecting element. The connecting element connects the first fixing plate and the second fixing plate such that a clamping space for clamping the moving member is defined between the first fixing plate and the second fixing plate.

The second fixing plate includes a recessed portion. When the moving member is pivoted to the extended position, the recessed portion is mounted on the bearing portion of the supporting frame.

The technical features described above have the following effects:

With the connecting portion of the supporting frame fixedly connected to the stationary base, and the moving member configured to rest on the bearing portion of the supporting frame, plus the locking effect of the pin, the stationary base and the moving member not only are well supported in either of the collapsed position and the extended position, but also are kept from falling apart while the moving member is being pivoted.

DETAILED DESCRIPTION OF THE INVENTION

The present invention incorporates the foregoing technical features into a collapsible exercise machine whose structure and major effects are now detailed with reference to the following embodiments.

Figure 1:
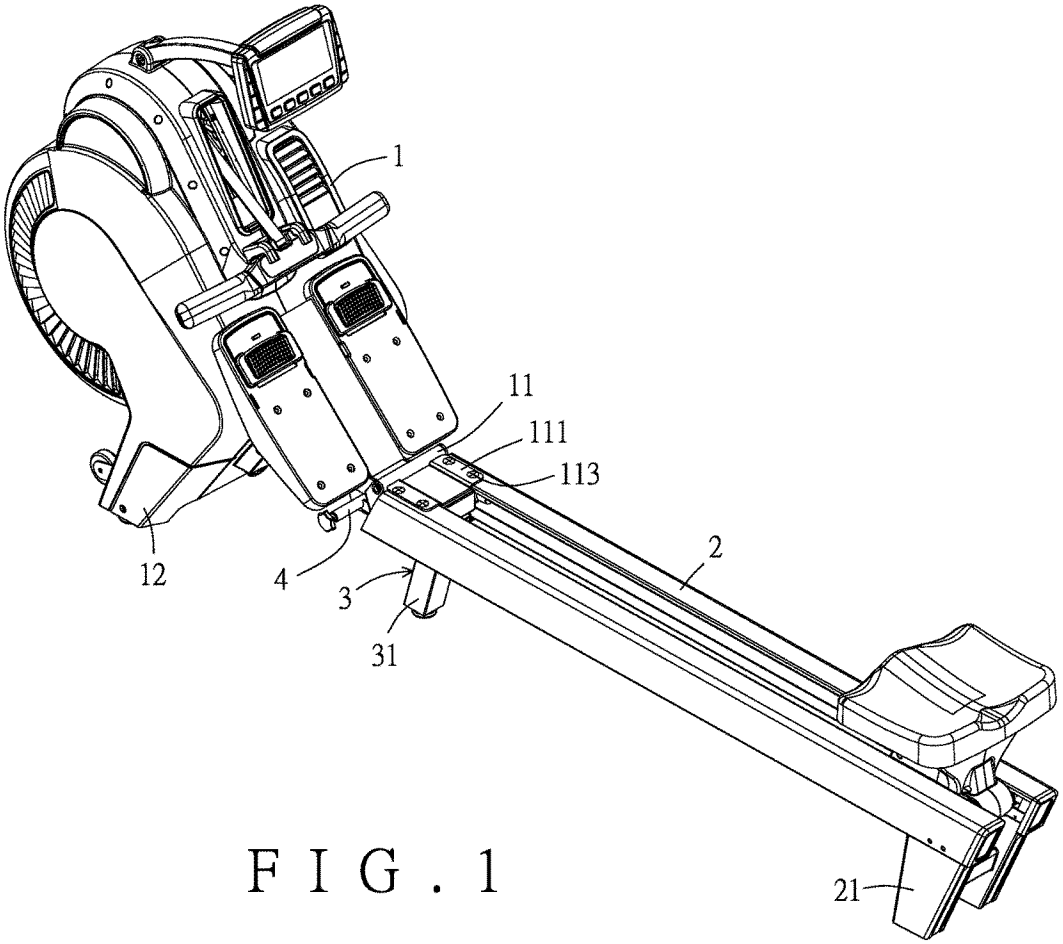
FIG. 1 is a perspective view of an embodiment of the present invention.
Figure 3:
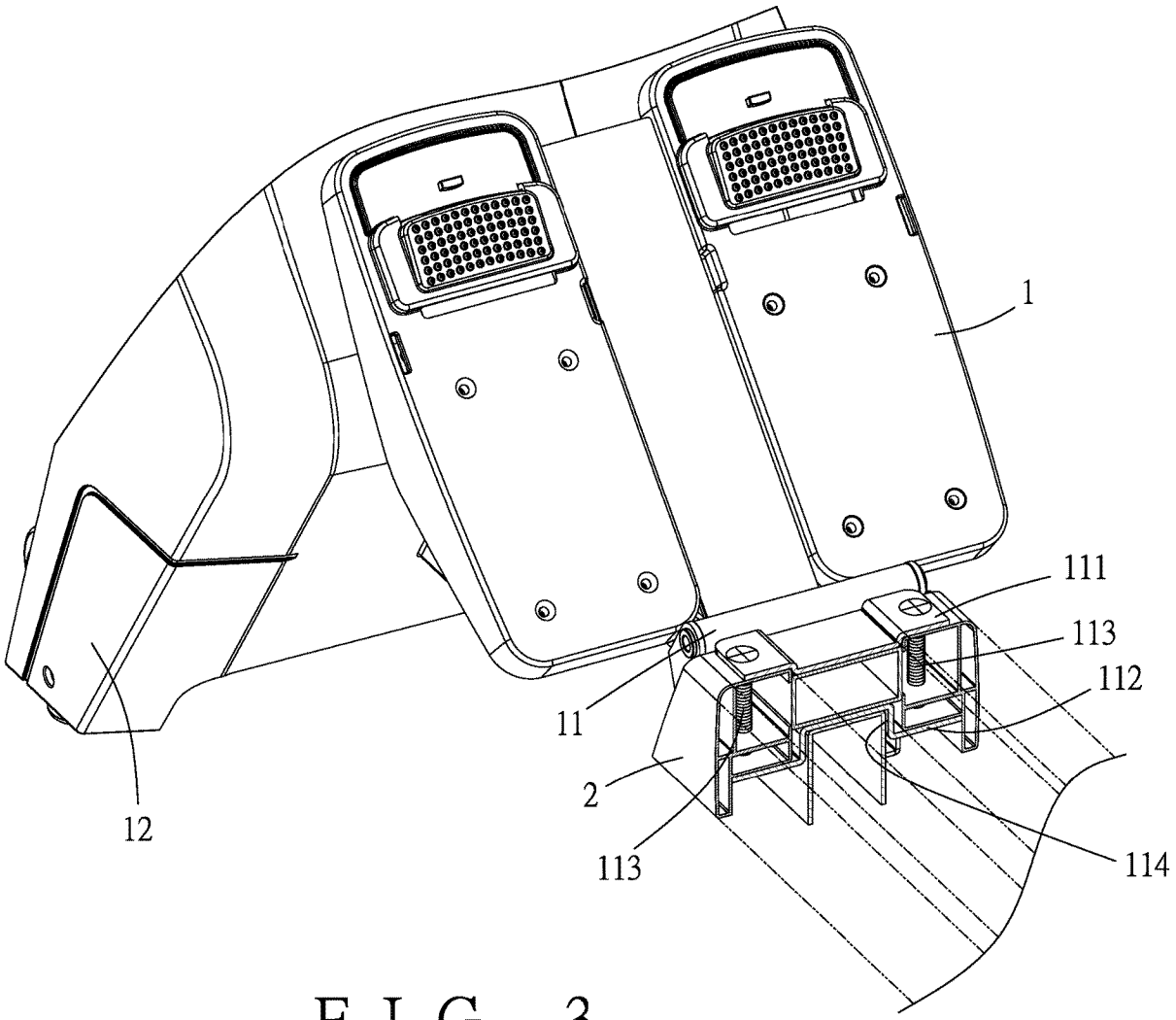
FIG. 3 is a sectional view of the pivotally connecting portion in the embodiment of FIG. 1.

Referring to FIG. 1 and FIG. 3, the collapsible exercise machine in a preferred embodiment of the present invention includes a stationary base 1, a moving member 2, a supporting frame 3, and a pin 4.

The stationary base 1 includes a pivotally connecting portion 11 and a first supporting portion 12. The pivotally connecting portion 11 includes a first fixing plate 111, a second fixing plate 112, and a connecting element 113. The connecting element 113 connects the first fixing plate 111 and the second fixing plate 112 in such a way that a clamping space is defined between the first fixing plate 111 and the second fixing plate 112. The second fixing plate 112 includes a recessed portion 114.

The moving member 2 is pivotally connected to the pivotally connecting portion 11 of the stationary base 1. The moving member 2 is configured to pivot to an extended position and a collapsed position with respect to the stationary base 1. The moving member 2 includes a second supporting portion 21. The moving member 2 has one end placed in the clamping space and thus clamped between the first fixing plate 111 and the second fixing plate 112, with the top of the moving member 2 in close contact with the first fixing plate 111, and the bottom of the moving member 2 in close contact with the second fixing plate 112.

Figure 2:
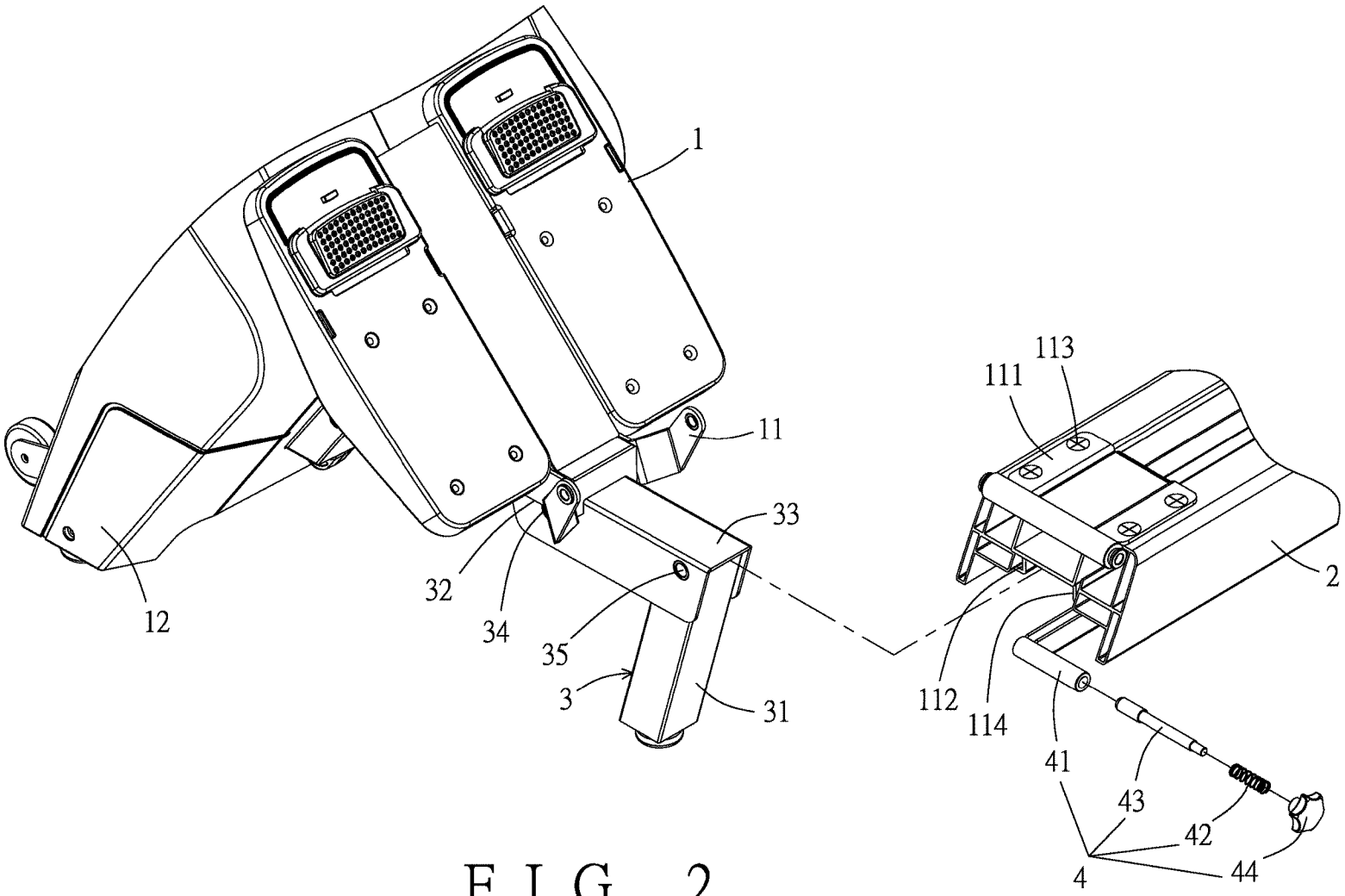
FIG. 2 shows how the moving member in the embodiment of FIG. 1 is pivotally connected to the stationary base.
Figure 4:
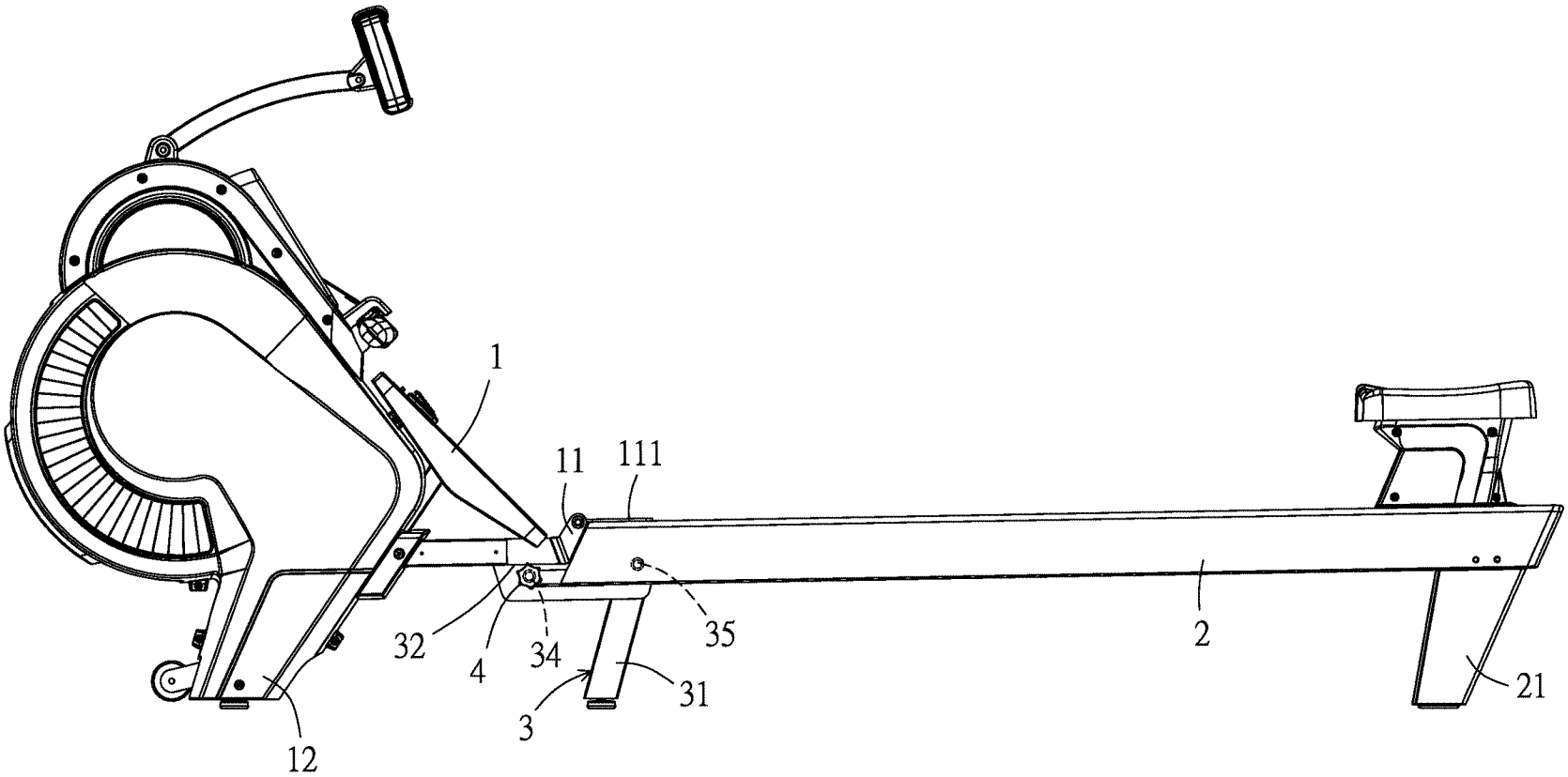
FIG. 4 shows the moving member in the embodiment of FIG. 1 after it is pivoted to the extended position.

As shown in FIG. 2 and FIG. 4, the supporting frame 3 is located under the pivotally connecting portion 11 and includes a third supporting portion 31. The supporting frame 3 further includes a connecting portion 32 and a bearing portion 33. The connecting portion 32 is fixedly connected to the stationary base 1. The bearing portion 33 is so configured that the moving member 2, once pivoted to the extended position with respect to the stationary base 1, can rest on the bearing portion 33, with the recessed portion 114 mounted on the bearing portion 33 of the supporting frame 3. The third supporting portion 31 is configured to correspond to the first supporting portion 12 and the second supporting portion 21 when in the extended position, in order for the supporting frame 3 to assist in supporting the stationary base 1 and the moving member 2. The supporting frame 3 has at least one positioning hole. In this embodiment, the supporting frame 3 has two positioning holes, which are an extended position-locking pin hole 34 and a collapsed position-locking pin hole 35 respectively.

Figure 5:
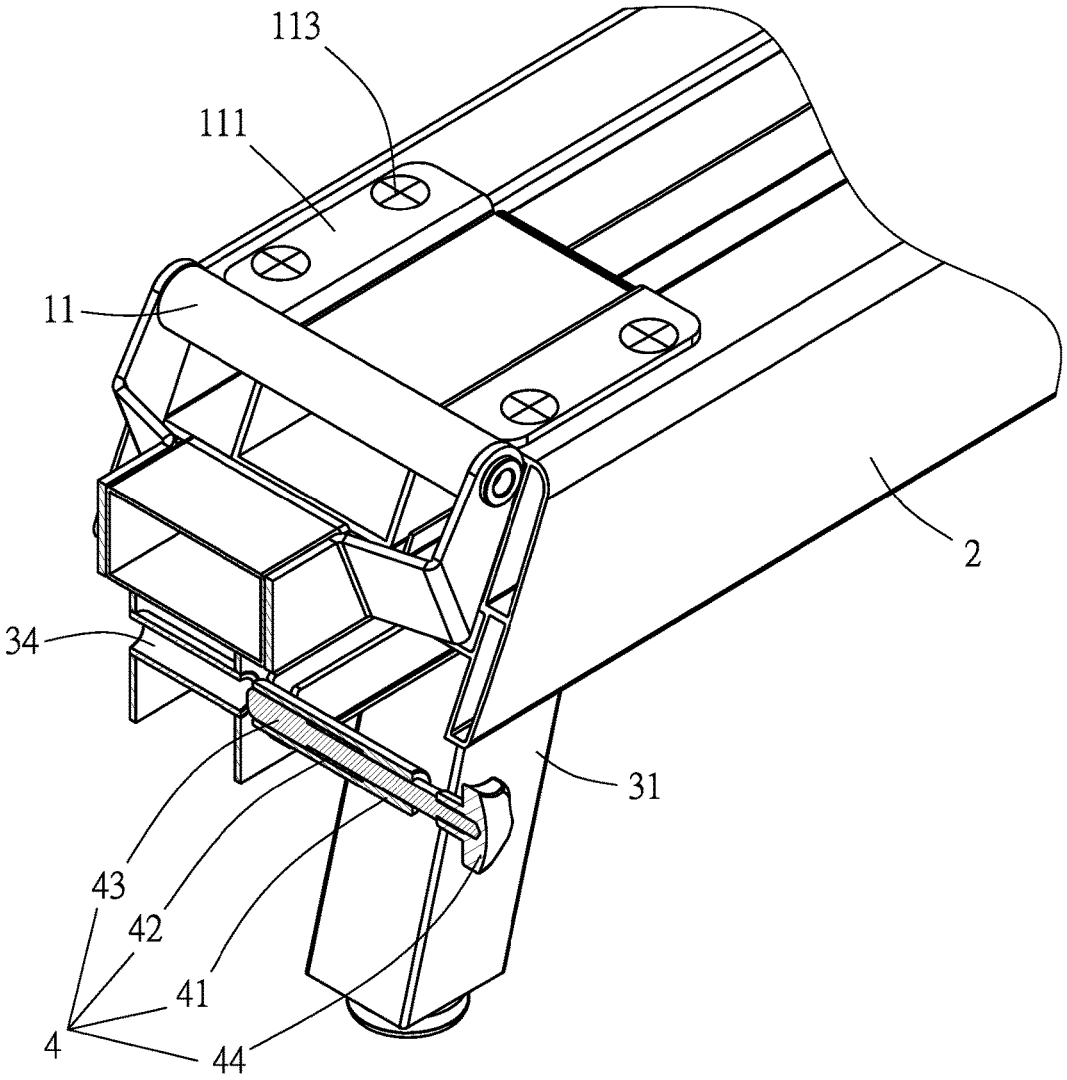
FIG. 5 is a sectional view in which the pin in the embodiment of FIG. 1 is in the first position.
Figure 6:
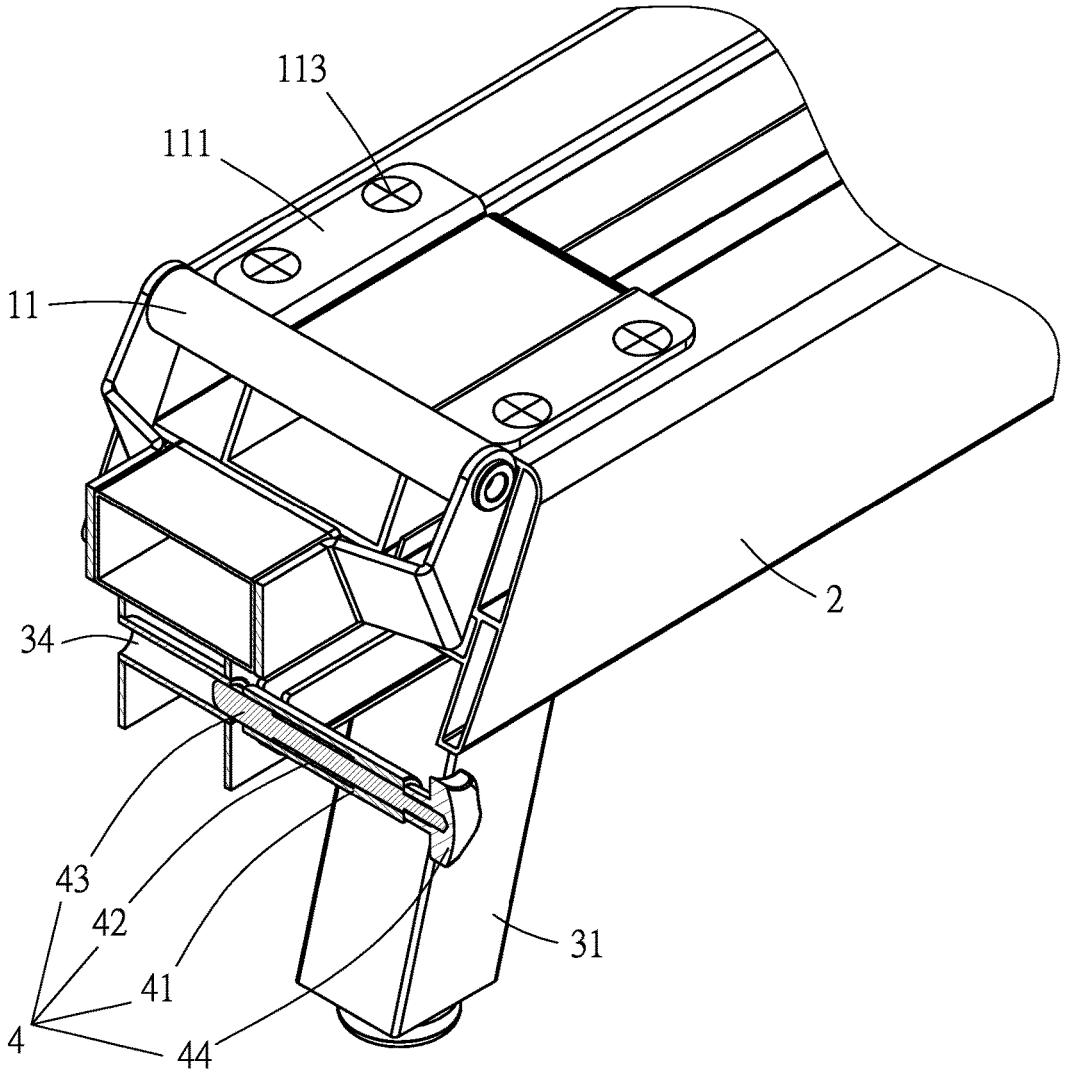
FIG. 6 is a sectional view in which the pin in the embodiment of FIG. 1 is in the second position.

Referring to FIG. 5 and FIG. 6, the pin 4 includes a receiving sleeve 41, an elastic restoring member 42, an inserting member 43, and a cap 44. The receiving sleeve 41 has one end fixedly connected to the moving member 2 and the other end connected to the cap 44. The elastic restoring member 42 and the inserting member 43 are both received in the receiving sleeve 41. The two ends of the elastic restoring member 42 are pressed against the inserting member 43 and the receiving sleeve 41 respectively.

The pin 4 is movably connected to the supporting frame 3 and can be displaced between a first position (see FIG. 5) and a second position (see FIG. 6). When the pin 4 is in the first position, the moving member 2 can pivot with respect to the stationary base 1. When brought back to the second position by the elastic restoring member 42, the pin 4 is engaged in either of the positioning holes and thereby locks the moving member 2 in the collapsed position or the extended position respectively.

Figure 7:
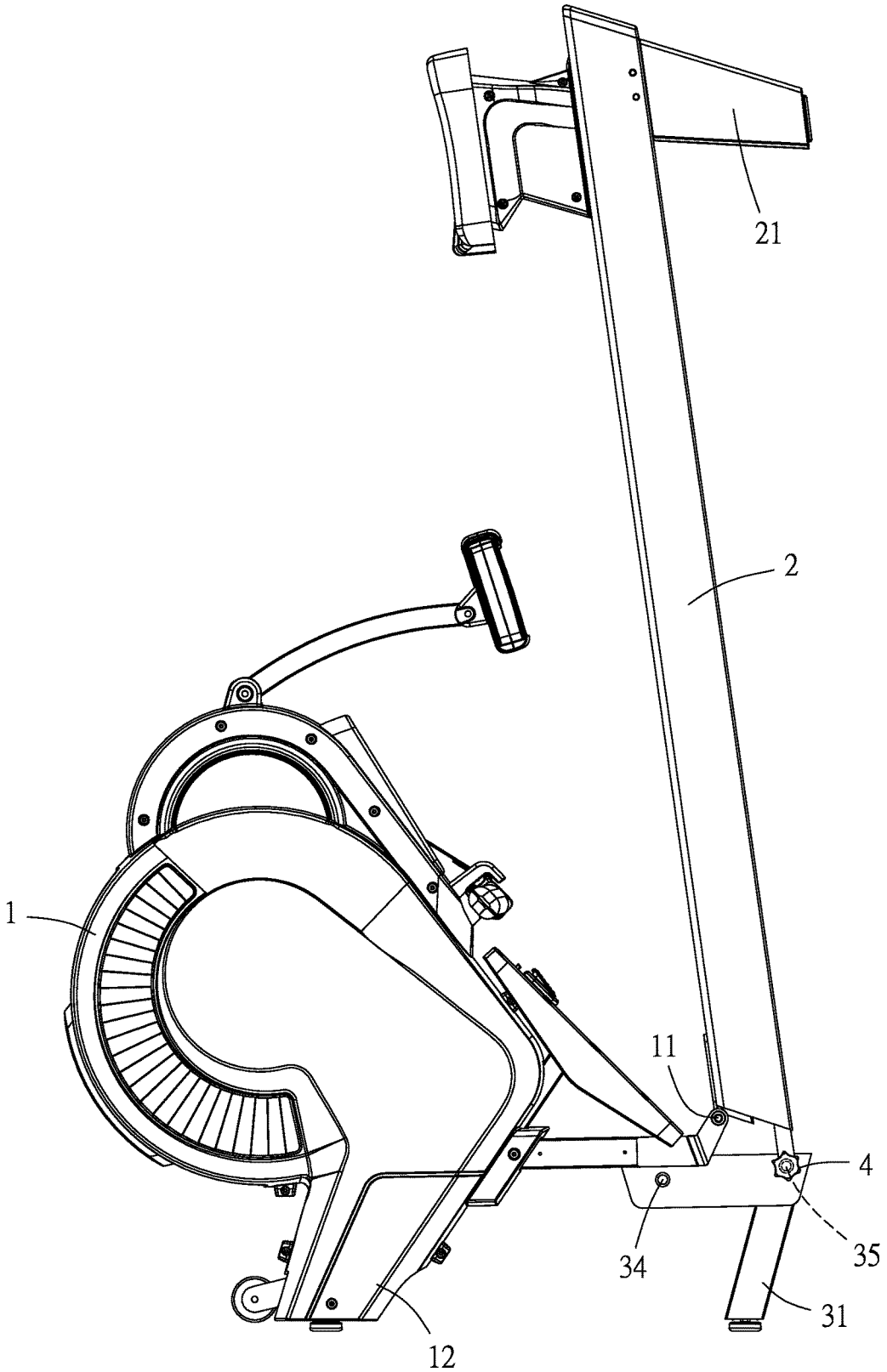
FIG. 7 shows the moving member in the embodiment of FIG. 1 after it is pivoted to the collapsed position.

Referring to FIG. 7, the pin 4 is selectively engaged in the extended position-locking pin hole 34 or the collapsed position-locking pin hole 35. When the pin 4 is engaged in the extended position-locking pin hole 34, the moving member 2 is locked in the extended position (see FIG. 4). When the pin 4 is engaged in the collapsed position-locking pin hole 35, the moving member 2 is locked in the collapsed position (see FIG. 7).

Figure 8:
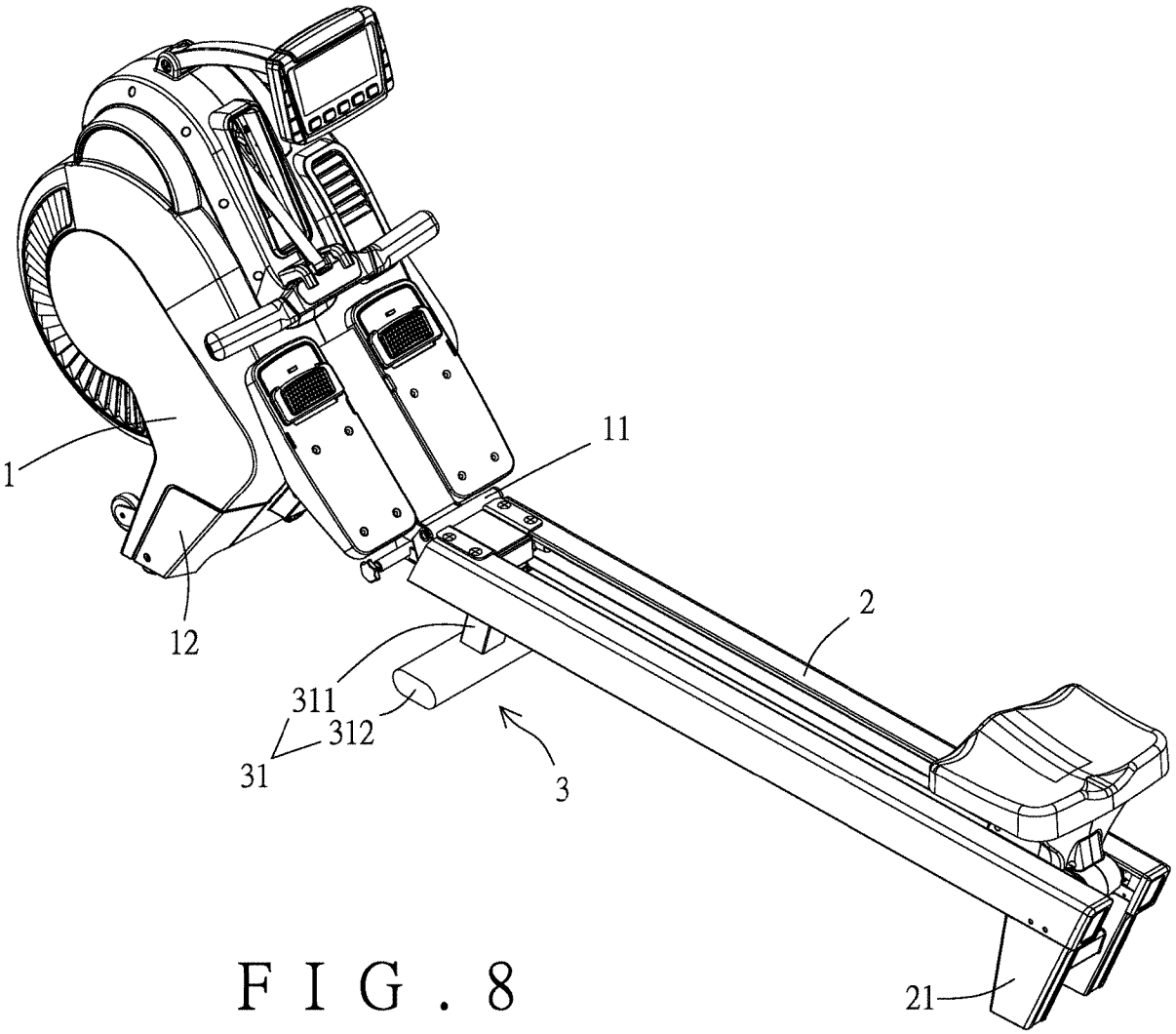
FIG. 8 is a perspective view of another embodiment of the present invention.

FIG. 8 shows another embodiment of the present invention, in which the third supporting portion 31 further includes a supporting member 311 and a foot member 312 perpendicularly connected to the supporting member 311. In this embodiment, the foot member 312 and the supporting member 311 jointly form a stand after the moving member 2 is pivoted to the extended position, wherein the stand corresponds to the first supporting portion 12 and the second supporting portion 21 in order for the supporting frame 3 to help support the stationary base 1 and the moving member 2 more firmly.

The above description of the two illustrative embodiments should be able to enable a person of ordinary skill in the art to fully understand the operation, use, and effects of the present invention. However, the embodiments provided herein are only some preferred embodiments of the present invention and are not intended to be restrictive of the scope of the invention. All simple, equivalent changes and modifications made according to the appended claims and the disclosure of this specification should fall within the scope of the present invention.

What is claimed is:

1. A collapsible exercise machine, comprising:

a stationary base including a pivotally connecting portion and a first supporting portion extending to a planar base surface;

a moving member pivotally connected to the pivotally connecting portion of the stationary base, the moving member being configured to pivot between an extended position and a collapsed position with respect to the stationary base, the moving member including a second supporting portion extending to the base surface when the moving member is in the extended position, the second supporting portion being displaced from the base surface when the moving member is in the collapsed position; and a supporting frame including a third supporting portion extending to the base surface, the supporting frame being fixedly connected to the stationary base, the supporting frame being positioned under the pivotally connecting portion, wherein the third supporting portion together with the first supporting portion extend to the base surface for supporting the collapsible exercise machine with respect to the base surface when the moving member is in the collapsed position, and the second supporting portion together with the first supporting portion and the third supporting portion are disposed in a common plane defined by the base surface when the moving member is in the extended position.

2. The collapsible exercise machine of claim 1, further including a pin movably connected to the supporting frame, the pin being displaceable between a first position and a second position, the supporting frame having at least one positioning hole, wherein when the pin is in the first position, the moving member is allowed to pivot to the collapsed position or the extended position with respect to the stationary base, and when the pin is in the second position, the pin is engaged in the at least one positioning hole and thereby locks the moving member in the collapsed position or the extended position.

3. The collapsible exercise machine of claim 2, wherein the pin includes a receiving sleeve, an elastic restoring member, an inserting member, and a cap; the receiving sleeve has an end fixedly connected to the moving member and an opposite end connected to the cap; the elastic restoring member and the inserting member are received in the receiving sleeve; and the elastic restoring member has two ends respectively pressed against the inserting member and the receiving sleeve such that the pin is moved to correspond to the second position.

4. The collapsible exercise machine of claim 2, wherein the at least one positioning hole includes an extended position-locking pin hole and a collapsed position-locking pin hole, and the pin is selectively engaged in the extended position-locking pin hole or the collapsed position-locking pin hole to lock the moving member in the extended position or the collapsed position respectively.

5. The collapsible exercise machine of claim 1, wherein the supporting frame includes a connecting portion and a bearing portion, the connecting portion is fixedly connected to the stationary base, and the moving member rests on the bearing portion after being pivoted to the extended position.

6. The collapsible exercise machine of claim 5, wherein the pivotally connecting portion includes a first fixing plate, a second fixing plate, and a connecting element connecting the first fixing plate and the second fixing plate; the second fixing plate includes a recessed portion; and the recessed portion is mounted on the bearing portion of the supporting frame when the moving member is pivoted to the extended position.

7. The collapsible exercise machine of claim 1, wherein the pivotally connecting portion includes a first fixing plate, a second fixing plate, and a connecting element; and the connecting element connects the first fixing plate and the second fixing plate such that a clamping space for clamping the moving member is defined between the first fixing plate and the second fixing plate.

* * * * *